US008356732B2

(12) United States Patent
van der Heijden et al.

(10) Patent No.: US 8,356,732 B2
(45) Date of Patent: Jan. 22, 2013

(54) DISPENSING DEVICE

(75) Inventors: Edgar Ivo Maria van der Heijden, Broek Op Langedijk (NL); Peter Jozef Jan Albertz, Haarlem (NL); Sylvia Boshuizen, Leiden (NL)

(73) Assignee: REXAM Airspray N.V., Alkmaar (NL)

( * ) Notice: Subject to any disclaimer, the term of this patent is extended or adjusted under 35 U.S.C. 154(b) by 561 days.

(21) Appl. No.: 12/597,244

(22) PCT Filed: Apr. 26, 2007

(86) PCT No.: PCT/NL2007/000110

§ 371 (c)(1),
(2), (4) Date: Oct. 23, 2009

(87) PCT Pub. No.: WO2008/133491

PCT Pub. Date: Nov. 6, 2008

(65) Prior Publication Data

US 2010/0133300 A1 Jun. 3, 2010

(51) Int. Cl.
*B67D 7/76* (2010.01)

(52) U.S. Cl. ..... 222/190; 222/321.2

(58) Field of Classification Search ..... 222/190, 222/321.1, 321.7, 321.9, 327, 207, 209
See application file for complete search history.

(56) References Cited

U.S. PATENT DOCUMENTS

| | | | | | |
|---|---|---|---|---|---|
| 4,277,001 | A | * | 7/1981 | Nozawa | 222/321.4 |
| 4,880,161 | A | * | 11/1989 | Wright | 239/330 |
| 4,932,567 | A | | 6/1990 | Tanabe et al. | |
| 5,271,530 | A | | 12/1993 | Uehira et al. | |

FOREIGN PATENT DOCUMENTS

| | | | | | |
|---|---|---|---|---|---|
| EP | 0 565 713 | A1 | | 10/1993 | |
| GB | 821793 | | | 10/1959 | |
| JP | 62-282663 | A | | 12/1987 | |
| JP | 2-2886 | A | | 1/1990 | |
| JP | 6-48454 | A | | 2/1994 | |
| JP | 330004 | | * | 12/1995 | 222/321.7 |
| JP | 8-11921 | | * | 1/1996 | 222/190 |
| WO | 91/01259 | A1 | | 2/1991 | |
| WO | 03/035274 | A1 | | 5/2003 | |

* cited by examiner

*Primary Examiner* — Lien Ngo
(74) *Attorney, Agent, or Firm* — Hoffmann & Baron, LLP

(57) ABSTRACT

The present invention relates to a dispensing device comprising: —a container (2) for holding a liquid having an opening, and—a dispensing assembly (4) mountable on or in said opening, said dispensing assembly comprising: —a pump (5) having a pump chamber (7) and a pump inlet (6) comprising an inlet valve (9) and a pump outlet (8) comprising an outlet valve (10), and—a liquid supply channel (16), one end of said channel (16) being in fluid communication with said inlet (6), the other end being arranged in a bottom portion of said container (2), wherein a one-way valve (20) is arranged in said channel (16), and wherein an air inlet opening (17) is provided between said inlet valve (9) and said one-way valve.

14 Claims, 1 Drawing Sheet

DISPENSING DEVICE

CROSS-REFERENCE TO RELATED APPLICATIONS

This application is the National Stage of International Application No. PCT/NL2007/000110, filed Apr. 26, 2007, the contents of which is incorporated by reference herein.

FIELD OF THE INVENTION

The present invention relates to a dispensing device and a method for providing a dispensing device. Furthermore, the invention relates to a foam-forming device to be mounted in a dispensing device.

BACKGROUND OF THE INVENTION

Dispensing devices for liquid comprising a container and a dispensing assembly mounted on or in an opening of the container are well-known. The dispensing assembly which usually is to be operated by hand comprises a pump having an inlet and an outlet. The inlet is in fluid communication with the interior of the container, for instance via a dip tube, one end of the dip tube being connected to the inlet, the other end being arranged in a bottom portion of the interior of the container. By actuating the pump, liquid is drawn into the pump, and dispensed via the outlet through a dispensing opening. Such dispensing devices are applied for numerous applications, such as soap, shampoo, cleaning liquids, etc.

Next to dispensing devices for the dispensing of liquid, propellant-free foam dispensers are known. State of the art foam dispensing devices comprise an air pump and a liquid pump which can simultaneously be actuated by a common operating button. Upon actuation of the liquid and air pump, by a common actuation device, liquid and air are mixed in a mixing chamber and formed into a foam, which foam is dispensed through a dispensing opening. Such foam dispensing device is for instance disclosed in U.S. Pat. No. 5,271,530 or EP 565 713.

A disadvantage of these known foam dispensers is that for the provision of two separate pumps, a relatively large number of parts is needed, and the construction is rather complex. Furthermore, some difficulties may occur with respect to the sealing of the outlets of both pumps. Also, the air pump, in particular a piston air pump may be sensitive for the presence of water and/or soap.

In GB 821793 another foam dispensing device is disclosed. In this foam dispensing device a single liquid bellows pump is used for the dispensing of foam. In the liquid supply channel, i.e. the liquid path from the liquid held in the container to the inlet of the pump, a chamber is provided. In this chamber an air inlet opening is provided by means of an air conduit connected to the environment outside the foam dispensing device. When the bellows pump is actuated, liquid is drawn out of the container into the pump. This flow of liquid also sucks air out of the air inlet opening in the liquid flow. The liquid and air are mixed to form a foam to be dispensed through the outlet opening of the dispensing device.

Although the foam dispensing device as disclosed in GB 821793 provides a less complex alternative for the known dual pump foam dispensing device, it comprises a number of practical disadvantages with the result that the dispensing device has not been successfully introduced on the market.

SUMMARY OF THE INVENTION

The aim of the present invention is to provide a dispensing device for the dispensing of a foam, which provides advantages over prior art foam dispensing devices. The present invention provides a dispensing device comprising:

- a container for holding a liquid having an opening, and
- a dispensing assembly mountable on or in said opening, said dispensing assembly comprising:
  - a pump having a pump chamber and a pump inlet comprising a inlet valve and a pump outlet comprising an outlet valve, and
  - a liquid supply channel, one end of said channel being in fluid communication with said inlet, the other end being arranged in a bottom portion of said container, wherein a one-way valve is arranged in said channel, and wherein an air inlet opening is provided between said inlet valve and said one-way valve.

By providing an air inlet opening between the inlet valve and the one-way valve, air can be drawn into the liquid flow which is pumped through the channel. The mixture of liquid and air is formed into a foam and dispensed through a dispensing opening of the dispensing device. With the relative simple construction a dispensing device is provided having a single pump and being capable of dispensing a foam.

The presence of a one-way valve in the channel upstream of the air inlet opening is advantageous as the liquid which is present in the channel may be held in the channel after dispensing of a foam. When the dispensing device is actuated the pump does not again have to draw liquid in the channel up to the one-way valve. The liquid can directly be pumped out of the channel, mixed with air and drawn into the pump chamber of the pump, and subsequently be dispensed through the dispensing opening. This reduces the number of pump strokes to be made with the pump before actually dispensing foam after the first use of the foam dispensing device. This is an important advantage as the user may be annoyed by idle pump strokes of the dispensing device.

To hold as much liquid as possible in the channel under the one-way valve, the one-way valve is preferably arranged at or above half the height of said channel, more preferably at or above 75% of the height of said channel.

In an embodiment, the dispensing device comprises a foam-forming device defining at least a part of said channel and defining at least partially said air inlet opening. The foam-forming device is a device which makes it possible to form a foam using a liquid pump. The forming of the foam does not have to actually take place in the foam-forming device. The foam-forming device defines at least partially the air inlet opening so that mounting of the foam-forming device provides the air inlet opening in the channel running to the inlet of the pump. In an embodiment, the foam-forming device comprises said one-way valve.

In an embodiment, the dispensing assembly comprises a dip tube defining at least a part of said channel. The dip tube may be used to bridge the distance between the inlet of the pump an the bottom portion of the interior of the container so that the in an upright position of the dispensing device the container can be emptied via the dip tube.

In an embodiment, the foam-forming device is arranged between said pump inlet and said dip tube. Dip tubes are often used in dispensing devices. By designing the foam-forming device in such a way that it can placed between the pump inlet and the dip tube of an existing liquid dispensing device, the liquid dispensing device can be easily transformed into a foam dispensing device without the need to make any fundamental changes to the liquid dispensing device except the mounting of the foam-dispensing device and shortening the dip tube. The dip tube may however also be integrally provided on the foam-forming device, or another dip tube may be provided.

In an embodiment, a sponge or sponge-like material is arranged in a pump chamber of said pump. The sponge or sponge-like material can hold an amount of liquid and air pumped into the pump chamber of the pump, but not yet dispensed through the outlet of the pump. The sponge or sponge-like material may substantially improve the forming of foam in the dispensing device, in particular since it is squeezed every time the pump is actuated.

The pump of the dispensing device may be a bellows pump, piston pump or any other type of pump suitable for the dispensing of a foamable liquid. The pump is preferably manually actuable.

In an embodiment, two or more air inlet openings may be provided in said channel. By providing two or more air inlet openings the introduction of air into the liquid flow and therewith the formation of foam may be substantially increased. The two or more inlet openings are preferably evenly distributed about the circumference of the channel.

The invention also relates to a method for providing a foam dispensing device, comprising the steps of:

providing a liquid dispensing device having:

a container for holding a foamable liquid having an opening, and a dispensing assembly mounted or to be mounted on or in said opening, comprising a pump having a pump chamber and an inlet comprising an inlet valve and an outlet comprising an outlet valve, and arranging a foam-forming device on or in said inlet of said pump, said foam-forming device defining at least a part of a liquid supply channel, said foam forming assembly comprising a one-way valve and defining at least partially an air inlet opening, said air inlet opening being provided between said inlet valve and said one-way valve.

The invention also relates to a foam-forming device mountable on or in an inlet of a liquid pump, defining at least a part of a liquid supply channel, said foam forming assembly further comprising a one-way valve and defining at least partially an air inlet opening, said air inlet opening being provided between said inlet and said one-way valve.

BRIEF DESCRIPTION OF THE DRAWINGS

Further characteristics and advantages will now be described in relation to an embodiment of the present invention, whereby Reference will be made to the appended drawings, in which.

DETAILED DESCRIPTION OF PREFERRED EMBODIMENTS

Figure 1:
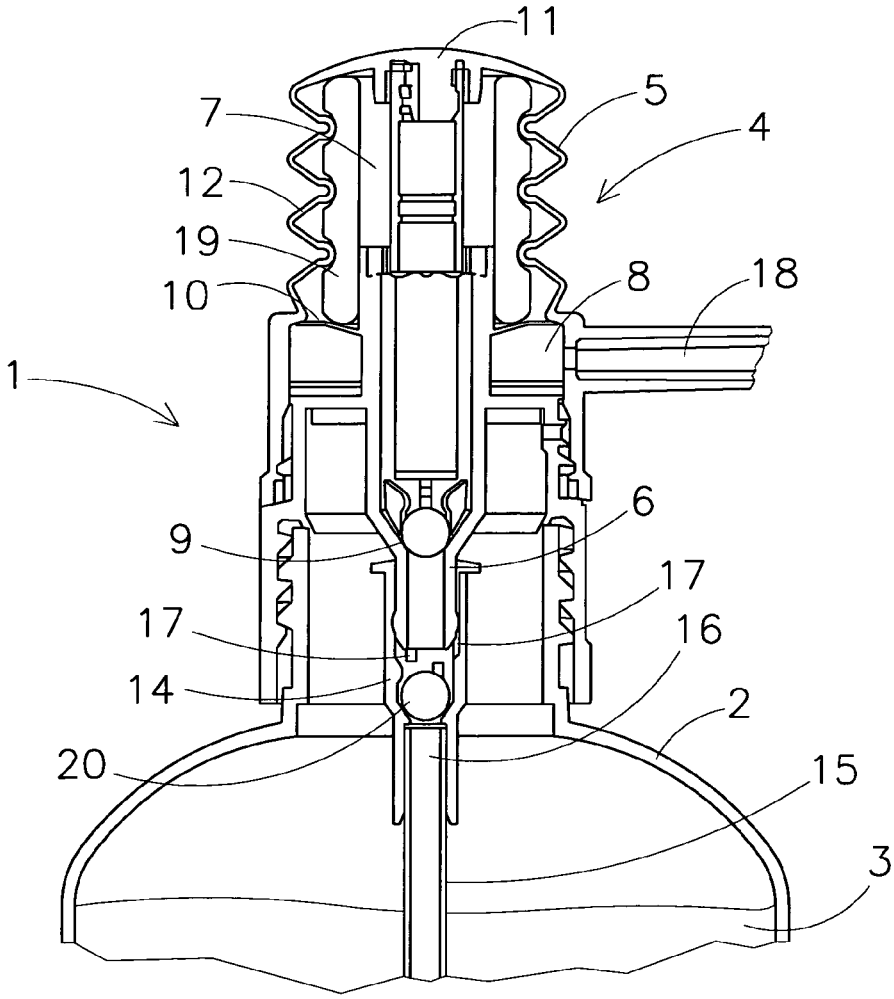
FIG. 1 shows a first embodiment of a foam dispensing device according to the present invention.

FIG. 1 shows a foam dispensing device according to the invention generally indicated with the reference numeral 1. The foam dispensing device 1 comprises a container 2 (In FIG. 1 only the top part is shown) holding a quantity of foamable liquid 3. In the container 2 an opening is provided on which a dispensing assembly 4 is mounted.

The dispensing assembly 4 comprises a bellows type pump 5 having an inlet 6, a pump chamber 7 and an outlet 8. In the inlet 6 an inlet valve 9 is provided, and in the outlet 8 an outlet valve 10 is provided. The top portion 11 of the bellows pump 5 serves as actuation button and can be actuated manually and reciprocally in vertical direction by pressing the top portion downwards. The cylindrical bellows side 12 is designed to bias the top portion 11 back in the top position as shown in FIG. 1, when no downwards pressure is exerted on the top portion 11. This biasing may be provided by the elasticity of the bellows material itself or may be provided by a spring, for instance embedded in the bellows material.

The inlet 6 of the pump 5 is connected to a top side of a foam-forming device 14. The bottom side of the foam-forming device 14 is connected to a dip tube 15. The foam-forming device and the dip tube 15 define a channel 16 which runs from a bottom portion of the interior of the container 2 to the inlet 6 of the pump 5.

In an alternative embodiment the dip tube may be an integral part of the foam-forming device 14. A separate dip tube has the advantage that the foam-forming device 14 can easily be adapted for different kinds of containers by providing dip tubes with different shapes and/or heights. In another embodiment, the dip tube may be integral with the foam-forming device, and optionally a dip tube of suitable length may be connected to the dip tube to adapt the height of the channel 16 to the container.

The foam-forming device 14 defines an air inlet opening 17 which provides an air path between the channel 16 and an air containing top portion of the interior of the container 2.

When the top portion of the bellows pump 5 is pressed downwards the volume of the pump chamber 7 is decreased. As no liquid is present in the pump chamber 7, no liquid or foam will be dispensed.

When the bellows pump 5 is released, liquid 3 will be drawn from the container 2 through the channel 15 into the pump chamber 7. While liquid is being sucked up from the container 2, simultaneously air will be drawn through the air inlet opening 17 into the liquid flow in the channel 16. As a result, a mixture of liquid and air is drawn into the pump chamber 7. Due to the drawing of the mixture and air into the pump chamber 7, in particular due to the turbulence in the flow, a foam may already come into existence.

When the top portion 11 is again in the top position, a liquid-air mixture/foam is present in the pump chamber 7. In a next compression stroke of the bellows pump 5, the liquid-air mixture will be (further) formed to a foam which is dispensed through the outlet 8 and the dispensing opening 18.

When top portion 11 is released the bellows pump will again be urged to the decompressed top position therewith again drawing liquid and air into the pump chamber 7 which can be dispensed in the form of a foam by further actuation of the bellows pump 5.

In the pump chamber 7 a sponge 19 is arranged, which is for instance made of a closed or open cell foam material. Any other sponge-like material may also be applied. This sponge 19 is compressible and may contain a quantity of liquid-air mixture. The sponge 19 is sized in such a way that during the compressing stroke of the bellows pump 5, the sponge 19 is compressed, and during the upwards movement the sponge 19 may decompress to substantially its original size. This compressing and decompressing of the sponge 19 improves substantially the quality of the foam dispensed by the foam dispensing device 1.

As an alternative or in addition to the sponge or sponge-like material 19 other devices improving the forming of foam such as sieves or porous material in the dispensing path, for instance in the dispensing opening 18 may be provided When the dispensing device 1 is not used for a certain time, liquid in the channel 16 will have the tendency to run back into the container 2, in particular since air may enter the channel 15 through the air inlet opening 17. When the dispensing device is actuated, first liquid has to be pumped into the channel before foam can be dispensed by the dispensing device. This will require at least one extra, but in practice often more than one actuation stroke before foam is actually dispensed. It has shown that users find these extra strokes for dispensing a foam a significant disadvantage in the use of a foam dispensing device.

To avoid the running of liquid out of the channel 16, a one-way valve 20 is provided in channel 16. This one-way valve 20 allows a liquid flow in the direction of the pump, but does not allow a flow in the opposite direction. Thus, when no liquid is drawn to the pump chamber 7, the one-way valve 20 will close the channel 16. As a result, it is possible to maintain the liquid column in the channel 15 avoiding the need of the extra strokes to pump the liquid back into the channel.

In an alternative embodiment the one-way valve 20 may be provided in the dip tube. The one-way valve 20 may be any passive or active valve which substantially avoids that liquid present in the channel 16 under the one-way valve 20 will not run back into the container 2.

Figure 2:
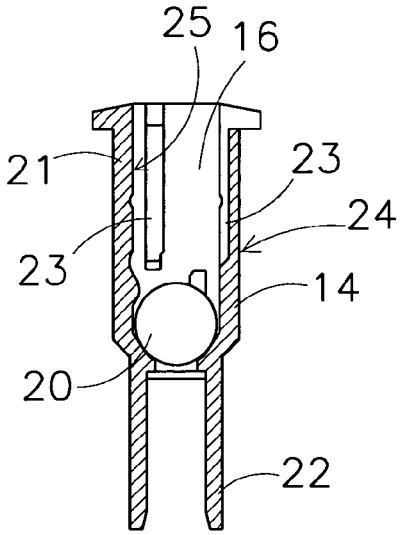
FIG. 2 shows the foam-forming assembly of FIG. 1 in more detail.

In FIG. 2 the foam-forming device 14 is shown in more detail. The foam-forming device 14 comprises a tube shaped top end 21 which can be mounted on or in the inlet 6 of the pump. A tube shaped bottom end 22 of the foam-forming device 14 is connected to the dip tube 15.

It is advantageous that the tube shaped top end 21 of the foam-forming device 14 has substantially the same shape as the top end of the dip tube 15, and/or that the tube shaped bottom end 22 of the foam-forming device 14 of the container has substantially the same shape as the inlet 6 of the pump 5.

In such embodiment the foam-forming device 14 can simply be placed between the inlet 6 of a liquid pump and the dip tube of said pump therewith transforming a known liquid dispensing device into a foam dispensing device. A known liquid dispensing device suitable for such transformation is for instance disclosed in WO03/035274 A1, the contents of which is herein incorporated by reference. In this publication the functioning of this liquid dispensing device is explained in more detail.

When actually transforming a known liquid dispensing device into a foam-forming device, the dip tube 15 of the known dispensing device may be too ling for the dispensing device due to the height of the foam-forming device. In such case the dip tube 15 may be shortened or replaced by another one. Also a dip tube may be integrally provided on the foam-forming device 14.

The foam-forming device 14 further comprises a number of grooves 23. The presence of the grooves 23 in the foam-forming device 14 define when the foam-forming device 14 is placed on the inlet 6 of the pump 5 the one or more air inlet openings 16 required for the provision of air into the liquid flow.

In an alternative embodiment through-going holes may be provided in the foam-forming device 14 running from the outer surface 24 of the foam-forming device to the channel 16 at least partially defined by the inner surface 25 of the foam-forming device 14. Also, air inlet conduits may be provided which run from the channel 16 to the environment outside the dispensing device. Such air inlet conduits may be advantageous in the case the container is a compressible container which is not aerated, or any other type of container which does not comprise air. Such containers are for instance used for liquids which easily oxidize or are easily contaminated.

It may be advantageous to provide more than one air inlet openings 17 in the channel 16 as this may substantially improve the forming of foam in the air-liquid mixture flow. Furthermore, it is desirable to make the air inlet openings 17 relatively small. In view of this it may be advantageous to provide grooves on the inner surface of the foam-forming device 14 to provide the air inlet openings 17 instead of through-going openings, as grooves may be more easily and accurately manufactured. In the embodiment of FIGS. 1 and 2 three vertical grooves 23 (only two shown) are provided in the foam-forming device, the grooves being equidistantly being arranged on the cylindrical inner surface 25 of the foam-forming unit 14. These grooves 23 provide when mounted on the inlet 6 the air inlet openings 17. More than three grooves may be provided to obtain a plurality of air inlet openings about the circumference of the channel 16.

Preferably, the transverse dimension of the air inlet openings 17 is not greater than about 1 mm, more preferably smaller than 0.25 mm.

In an alternative embodiment grooves may be provided on the inlet 6 on or both the inlet 6 and the foam-forming unit 14 to provide the air inlet openings 17 for forming a foam.

In another alternative embodiment of a foam-forming device according to the invention the air inlet openings may be formed as generally described in WO 91/01259, the contents of which is herein incorporated by reference. An exemplary embodiment of such foam-forming device is shown in FIG. 3.

This foam-forming device 30 comprises an end surface 31 which is provided with grooves 32. The end surface 31 abuts, when mounted on the inlet 6 of a liquid pump, against an end surface 33 of the inlet 6 of the liquid pump. The grooves 32 and the end surface 33 define horizontal air channels 34. The foam-forming device further comprises a cylindrical shoulder 35 which is at the inside also provided with vertical grooves 36. The outer surface of the inlet 6 and the vertical grooves 36 define vertical air channels 37 connected to the horizontal air channels 34. The horizontal air channels 34 and vertical air channels 37 form a channel to the air inlet openings to introduce air into the liquid flow when liquid is pumped by the liquid pump.

Figure 3:
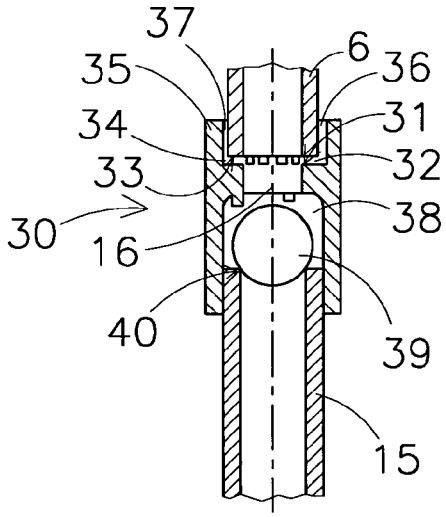
FIG. 3 shows an alternative embodiment of a foam-forming assembly arranged on an inlet of a pump.

As can been seen in FIG. 3 the foam-forming device 30 comprises a plurality of horizontal and vertical grooves to provide a plurality of air inlet openings distributed evenly about the circumference of the channel 16.

In alternative embodiments only the horizontal grooves may be provided. In general, the dispensing device comprises two parts having abutting end surfaces, at least one of said end surfaces being provided with grooves to define air channels as air inlet openings. The two parts may both be part of the foam-forming device, or for example one part may be part of the foam-forming device and the other part may be the inlet of a pump as shown in FIG. 3.

At the bottom side of the foam-forming device an opening 38 is provided in which a dip tube 15 is arranged. A ball 39 is held in this opening above the dip tube 15. The upper inside rim of the dip tube forms a seat 40 for the ball. The combination of ball 39 and seat 40 provides a one-way valve. Other embodiments of the one-way valve may also be applied.

The invention claimed is:

1. A dispensing device for dispensing a foam, comprising:
a container for holding a liquid and having an opening, and
a dispensing assembly mountable on or in said opening, said dispensing assembly comprising:
a pump having a pump chamber and a pump inlet comprising an inlet valve and a pump outlet comprising an outlet valve, and a liquid supply channel, one end of said channel being in fluid communication with said pump inlet, the other end being arranged in a bottom portion of said container, wherein the dispensing device comprises a separate foam-forming device mounted on or in the pump inlet of the pump, defining at least a part of the liquid supply channel, said foam-forming device further comprising a one-way valve and defining at least partially an air inlet opening to the liquid supply channel, said air inlet opening being provided between said pump inlet and said one-way valve.

2. Dispensing device as claimed in claim 1, wherein said dispensing assembly comprises a dip tube defining at least a part of said channel.

3. Dispensing device as claimed in claim 1, wherein said foam-forming device is arranged between said pump inlet and said dip tube.

4. Dispensing device as claimed in claim 1, wherein said pump inlet comprises a tube shaped end comprising an inlet opening, the foam-forming device having a tube shaped top end to be arranged on or in said tube shaped end of said pump inlet.

5. Dispensing device as claimed in claim 4, wherein said tube shaped end of said pump inlet and/or said tube shaped top end of said foam-forming device comprises one or more grooves which define said air inlet opening.

6. Dispensing device as claimed in claim 3, wherein said foam-forming device comprises a tube shaped bottom end, wherein said one end of said dip tube is or is to be arranged on or in said tube shaped bottom end of said foam-forming device.

7. Dispensing device as claimed in claim 1, wherein said air opening is in fluid communication with a top portion of the interior of said container.

8. Dispensing device as claimed in claim 1, wherein a sponge or sponge-like material is arranged in said pump chamber.

9. Dispensing device as claimed in claim 1, wherein said one-way valve is arranged at or above half the height of said channel, preferably at or above 75% of the height of said channel.

10. Dispensing device as claimed in claim 1, wherein two or more air inlet openings are provided between said inlet valve and said one-way valve.

11. Dispensing device as claimed in claim 1, wherein two or more air inlet openings are provided in said channel.

12. Method for providing a foam dispensing device, comprising the steps of:

providing a liquid dispensing device having:

a container for holding a foamable liquid having an opening, and a dispensing assembly mounted or to be mounted on or in said opening, comprising a single liquid pump having a pump chamber and an inlet comprising an inlet valve and an outlet comprising an outlet valve, and mounting a separate foam-forming device on or in said inlet of said pump, said foam-forming device defining at least a part of a liquid supply channel to the inlet, said foam forming device comprising a one-way valve and defining at least partially an air inlet opening to the liquid supply channel, said air inlet opening being provided between said inlet valve and said one-way valve.

13. The method of claim 12, wherein the method further comprises arranging a dip tube in said dispensing device, one end of said dip tube being in fluid communication with said foam-forming device, the other end being arranged in a bottom portion of said container.

14. Foam-forming device mountable on or in an inlet of a liquid pump, defining, when mounted on the liquid pump, at least a part of a liquid supply channel to a pump inlet of the liquid pump, said foam-forming device further comprising a one-way valve and defining at least partially an air inlet opening to the liquid supply channel, said air inlet opening being provided between said inlet and said one-way valve.

* * * * *